US009834913B1

(12) United States Patent
Kimiagar

(10) Patent No.: US 9,834,913 B1
(45) Date of Patent: Dec. 5, 2017

(54) SHOWER HEAD ATTACHMENT

(71) Applicant: Salim Kimiagar, Woodland Hills, CA (US)

(72) Inventor: Salim Kimiagar, Woodland Hills, CA (US)

( * ) Notice: Subject to any disclaimer, the term of this patent is extended or adjusted under 35 U.S.C. 154(b) by 0 days.

(21) Appl. No.: 15/384,433

(22) Filed: Dec. 20, 2016

Related U.S. Application Data

(60) Provisional application No. 62/402,184, filed on Sep. 30, 2016.

(51) Int. Cl.
*A47K 3/022* (2006.01)
*E03C 1/044* (2006.01)
*E03C 1/04* (2006.01)

(52) U.S. Cl.
CPC ..... *E03C 1/044* (2013.01); *E03C 1/0408* (2013.01)

(58) Field of Classification Search
CPC ..... E03C 1/004; E03C 1/0408
USPC ..... 4/605
See application file for complete search history.

(56) References Cited

U.S. PATENT DOCUMENTS

D29,880 S 12/1898 Longden
4,358,056 A 11/1982 Greenhut
5,012,536 A 5/1991 Rivera
6,588,377 B1 * 7/2003 Leary ..... F24D 3/1008 122/13.01
7,490,373 B1 2/2009 Avelar
7,707,665 B1 * 5/2010 Hong ..... E03B 1/048 4/597
7,934,662 B1 5/2011 Jenkins
8,066,196 B2 11/2011 McMurtry
8,104,112 B2 1/2012 Tsai
8,876,012 B2 * 11/2014 McMurtry ..... E03B 1/048 137/337
9,353,955 B1 * 5/2016 Haws ..... F24D 17/0005

FOREIGN PATENT DOCUMENTS

WO 2016058069 A1 4/2016

* cited by examiner

*Primary Examiner* — Huyen Le
(74) *Attorney, Agent, or Firm* — Kyle A. Fletcher, Esq.

(57) ABSTRACT

The shower head attachment is installed in a shower head feed line The shower head attachment comprises a perforated tube, an expandable bladder, and a release valve. The release valve is installed between the perforated tube and the shower head. The perforated tube is contained within the expandable bladder. Water that flows through perforations of the perforated tube is stored within the expandable bladder. When the release valve is closed and the shower valve is opened, the pressure of the hot water line of the residential plumbing system forces cooled stored within the hot water line into the expandable bladder. The release valve is opened enabling the continued flow hot water into the perforated tube where the hot water mixes with the cooled water creating a more temperate water temperature that is released through the shower head.

20 Claims, 2 Drawing Sheets

SHOWER HEAD ATTACHMENT

CROSS REFERENCES TO RELATED APPLICATIONS

This non-provisional application claims priority under 35 USC 119(e) to United States provisional application U.S. 62/402,184 filed on Sep. 30, 2016 by the inventor: Salim Kimiagar of Woodland Hills, Calif.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of water supplies and sewage, more specifically, fresh water plumbing connection.

A shower is a bathing apparatus that is installed within a residential plumbing system. For the purposes of this disclosure, a shower further comprises a hot water line, a shower valve, a shower head feed line and a shower head. The hot water line feeds water from a water heater to the shower valve. The shower valve controls water flow into the shower head feed line. The shower head feed line routes water from the shower valve to the shower head. The shower head discharges water from the residential plumbing system for use in bathing.

Within residential plumbing systems a lack of continuous water flow provides an opportunity for hot water contained within hot water lines to cool over time. When hot water is subsequently called for the cooled water contained within the hot water lines must be discharged through the spout before hot water is reliably delivered through the system. This delay is invariably inconvenient and, in the case of showers, potentially uncomfortable for a bather.

Clearly, a method to warm cooled water contained with a hot water line would be of benefit in these situations.

SUMMARY OF INVENTION

The above shortcoming of residential plumbing systems are addressed in this disclosure.

The shower head attachment is used with a shower installed within a residential plumbing system. The shower head attachment is installed in the shower head feed line such that all water released through the shower valve will pass through the shower head attachment. The shower head attachment comprises a perforated tube, an expandable bladder, and a release valve. The release valve is installed between the perforated tube and the shower head. The perforated tube is contained within the expandable bladder such that water flows through perforations formed in the perforated tube will be contained and stored within the expandable bladder. When the release valve is closed and the shower valve is opened, the pressure of the hot water line of the residential plumbing system forces the cooled water stored within the hot water line into the expandable bladder where the cooled water is stored. Once the cooled water is evacuated from the hot water line into the expandable bladder, then the release valve is opened enabling the continued flow hot water into the perforated tube where the hot water mixes with the cooled water stored in the expandable bladder thereby creating a more temperate water temperature that is released through the shower head.

These together with additional objects, features and advantages of the shower head attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the shower head attachment in detail, it is to be understood that the shower head attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shower head attachment.

It is therefore important that the claims be regarded as including such equivalent construction insofar as they do not depart from the spirit and scope of the shower head attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
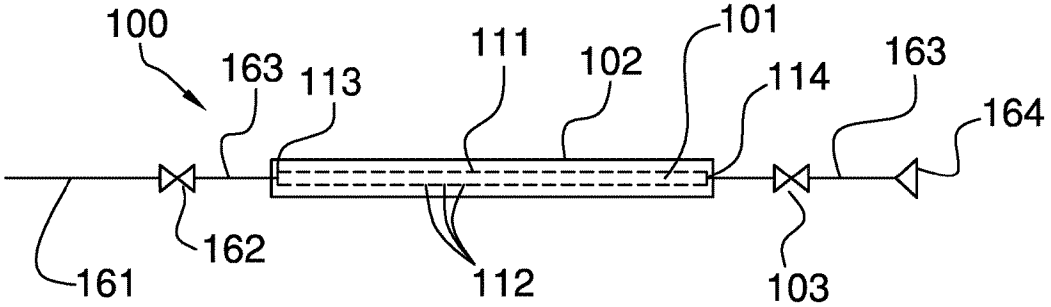
FIG. 1 is an installed schematic view of an embodiment of the disclosure.
Figure 2:
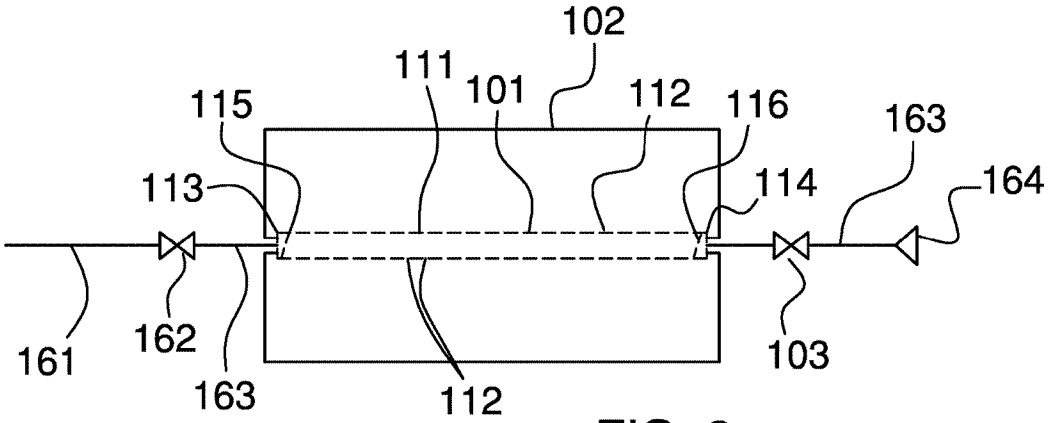
FIG. 2 is an in use schematic view of an embodiment of the disclosure.
Figure 3:
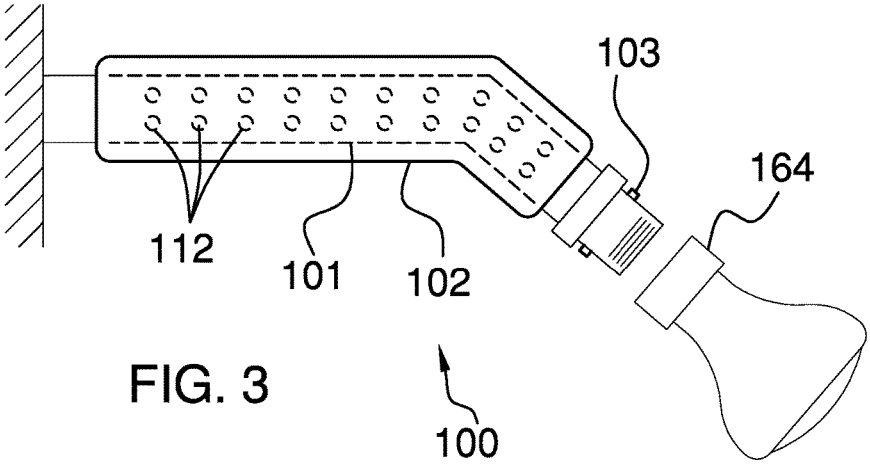
FIG. 3 is an unexpanded in use view of an embodiment of the disclosure.
Figure 4:
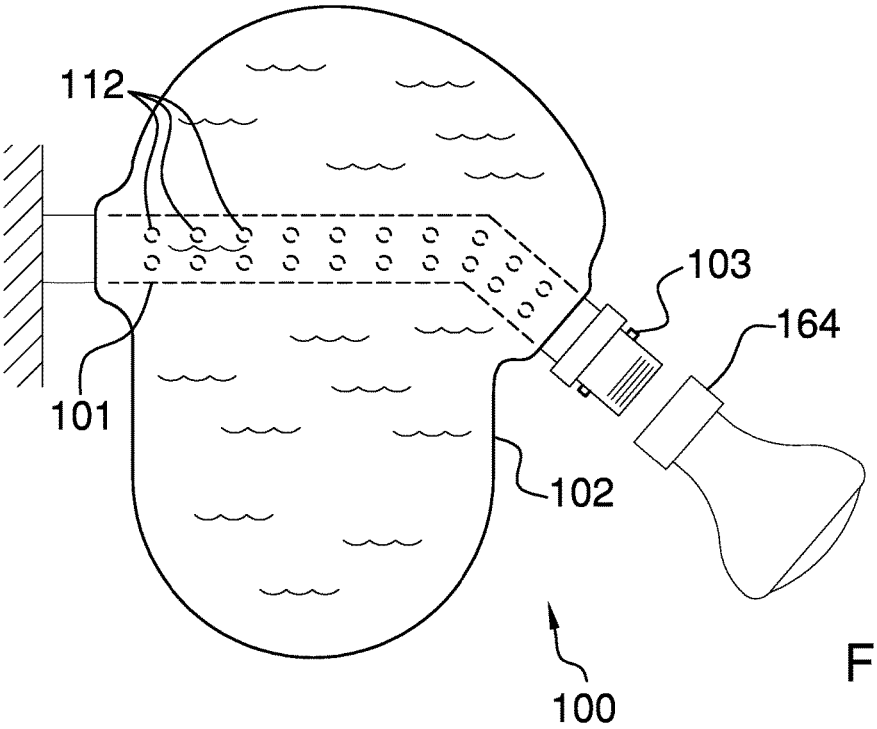
FIG. 4 is an expanded in use view of an embodiment of the disclosure.

Detailed reference will now be made to one or more potential embodiments of the disclosure, which are illustrated in FIGS. 1 through 4.

The shower head reservoir 100 (hereinafter invention) comprises a perforated tube 101, an expandable bladder 102, and a release valve 103. The release valve 103 is installed between the perforated tube 101 and the shower head 164. The perforated tube 101 is contained within the expandable bladder 102 such that water flows through a plurality of apertures each of which forms a perforations formed in the perforated tube 101. The perforated tube is contained and stored within the expandable bladder 102. The invention 100 is used with a shower installed within a residential plumbing system. The invention 100 is installed in the shower head feed line 163 such that all water released through the shower valve 162 will pass through the invention 100. When the release valve 103 is closed and the shower valve 162 is opened, the pressure of the hot water line 161 of the residential plumbing system forces the cooled water stored within the hot water line 161 into the expandable bladder 102 where the cooled water is stored. Once the cooled water is evacuated from the hot water line 161 into the expandable bladder 102, then the release valve 103 is opened enabling the continued flow hot water into the perforated tube 101 where the hot water mixes with the cooled water stored in the expandable bladder 102 thereby creating a more temperate water temperature that is released through the shower head 164 from the release valve 103.

The perforated tube 101 comprises a pipe 111, a plurality of apertures 112, a first threaded connection 115 and a second threaded connection 116. The pipe 111 is further defined with a first end 113 and a second end 114. The pipe 111 is a hollow cylindrical structure. The first threaded connection 115 is a standard threaded plumbing connection that is formed on the first end 113 of the pipe 111. The first threaded connection 115 allows the first end 113 of the pipe 111 to be connected to the portion of the shower head feed line 163 that connects the pipe 111 to the shower valve 162. The second threaded connection 116 is a standard threaded plumbing connection that is formed on the second end 114 of the pipe 111. The use of the second threaded connection 116 is discussed elsewhere in this disclosure. The plurality of apertures 112 are a plurality of ports that are formed within the cylinder face of the pipe 111. The plurality of apertures 112 are formed such that water flowing into the pipe 111 from the shower valve 162 can pass through the plurality of apertures 112.

The expandable bladder 102 is an expandable reservoir that is used to enclose the perforated tube 101. The purpose of the expandable bladder 102 is to store the cooled water contained within the hot water lines 161 when the shower valve 162 is first opened while the release valve 103 discussed below is closed. When this condition occurs, the pressure of the water within the hot water line 161 will force water through the plurality of apertures 112 into the expandable bladder 102.

The release valve 103 is a readily and commercially available valve that can be manually opened and closed. The release valve 103 allows water to flow from the perforated tube 101 to the shower head 164. The release valve 103 is fitted with a plurality of standard threaded plumbing connections that allows the release valve 103 to be connected to the second threaded connection 116 at the second end 114 of the perforated tube 101 and to the portion of the shower head feed line 163 that connects the pipe 111 to the shower head 164. In the circumstance where the release valve 103 is closed and the shower valve 162 is open, water will accumulate by design into the expandable bladder 102.

In the first potential embodiment of the disclosure, the perforated tube 101 is a standard plumbing pipe 111 that has the plurality of apertures 112 drilled into the cylinder face of the pipe 111. The expandable bladder 102 comprises a modification to one or more hydration reservoirs commonly used in outdoor activities. Methods to enclose tubes and pipes within such reservoirs in a water proof manner are well known and documented in the manufacturing arts. The release valve 103 is a readily and commercially available two port inline valve (straight).

The invention 100 is capable of being introduced into industrial or commercial applications. The invention 100 is not to be limited to just residential applications.

The following definitions were used in this disclosure:

Bladder: As used in this disclosure, a bladder is gas impermeable structure. The internal volume of the structure can be varied by: varying the pressure and or quantity of a gas contained within the bladder; or 2) varying the quantity of a liquid contained within the bladder. Bladders are commonly used for storage of a gas or liquid and as a cushion.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its original shape after the force is removed. A material that exhibits these qualities is also referred to as an elastomeric material.

Pipe: As used in this disclosure, a pipe is a hollow cylindrical device that is used for transporting liquids and gases. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Valve: As used in this disclosure, a valve is a device that is use to control the flow of a fluid (gas or liquid) through a pipe.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A plumbing attachment comprising:

a perforated tube, an expandable bladder, and a release valve;

wherein the perforated tube is contained within the expandable bladder;

wherein the plumbing attachment is used with a shower installed within a plumbing system;

wherein the shower is further defined with a hot water line, a shower valve, a shower head feed line, and a shower head;

wherein the plumbing attachment is installed in the shower head feed line such that all water released through the shower valve will pass through the plumbing attachment;

wherein the release valve is installed between the perforated tube and the shower head.

2. The plumbing attachment according to claim 1 wherein the perforated tube is contained within the expandable bladder such that water flows through perforations formed in the perforated tube will be contained and stored within the expandable bladder.

3. The plumbing attachment according to claim 2 wherein the perforated tube comprises a pipe, a first threaded connection and a second threaded connection;

wherein the pipe is further defined with a first end and a second end;

wherein the pipe is a hollow cylindrical structure;

wherein the first threaded connection is a standard threaded plumbing connection that is formed on the first end of the pipe;

wherein the first threaded connection allows the first end of the pipe to be connected to the portion of the shower head feed line that connects the pipe to the shower valve;

wherein the second threaded connection is a standard threaded plumbing connection that is formed on the second end of the pipe.

4. The plumbing attachment according to claim 3 wherein the perforated tube further comprises a plurality of apertures;

wherein the plurality of apertures are a plurality of ports that are formed within the cylinder face of the pipe;

wherein the plurality of apertures are formed such that water flowing into the pipe from the shower valve can pass through the plurality of apertures;

wherein each of the plurality of apertures forms a perforation within the perforated tube.

5. The plumbing attachment according to claim 4 wherein the expandable bladder is an expandable reservoir that is used to enclose the perforated tube;

wherein the expandable bladder stores water contained within the hot water line of the plumbing system.

6. The plumbing attachment according to claim 5 wherein the release valve is a valve that can be manually opened and closed.

7. The plumbing attachment according to claim 6 wherein the release valve controls water flow from the perforated tube to the shower head.

8. The plumbing attachment according to claim 7 wherein the release valve is fitted with a plurality of standard threaded plumbing connections that allows the release valve to be connected to the second threaded connection at the second end of the perforated tube;

wherein the release valve is fitted with a plurality of standard threaded plumbing connections that allows the release valve to be connected to the portion of the shower head feed line that connects the pipe to the shower head.

9. The plumbing attachment according to claim 8 wherein the release valve is a two port inline valve.

10. The plumbing attachment according to claim 9 wherein the release valve is a straight valve.

11. The plumbing attachment according to claim 10 wherein if the release valve is closed and the shower valve is opened then the pressure of the hot water line of the residential plumbing system forces any water stored within the hot water line into the expandable bladder.

12. The plumbing attachment according to claim 11 wherein if the release valve is opened and the shower valve is opened then the water flowing into the perforated tube will mix with the water stored within the expandable bladder.

13. The plumbing attachment according to claim 1 wherein if the release valve is closed and the shower valve is opened then the pressure of the hot water line of the residential plumbing system forces any water stored within the hot water line through the perforations of the perforated tube into the expandable bladder.

14. The plumbing attachment according to claim 13 wherein if the release valve is opened and the shower valve is opened then water flowing into the perforated tube will mix with the water stored within the expandable bladder.

15. The plumbing attachment according to claim 14 wherein the perforated tube comprises a pipe, a first threaded connection and a second threaded connection;

wherein the pipe is further defined with a first end and a second end;

wherein the pipe is a hollow cylindrical structure;

wherein the first threaded connection is a standard threaded plumbing connection that is formed on the first end of the pipe;

wherein the first threaded connection allows the first end of the pipe to be connected to the portion of the shower head feed line that connects the pipe to the shower valve;

wherein the second threaded connection is a standard threaded plumbing connection that is formed on the second end of the pipe.

16. The plumbing attachment according to claim 15 wherein the expandable bladder is an expandable reservoir that is used to enclose the perforated tube;

wherein the expandable bladder stores water contained within the hot water line of the plumbing system.

17. The plumbing attachment according to claim 16
wherein the release valve is a valve that can be manually opened and closed;
wherein the release valve controls water flow from the perforated tube to the shower head.

18. The plumbing attachment according to claim 17
wherein the release valve is fitted with a plurality of threaded plumbing connections;
wherein the release valve is fitted with a first threaded connection selected from the plurality of threaded plumbing connections that allows the release valve to be connected to the second threaded connection at the second end of the perforated tube.

19. The plumbing attachment according to claim 18
wherein the release valve is fitted with a second standard threaded connection selected from the plurality of threaded plumbing connections that allows the release valve to be connected to the portion of the shower head feed line that connects the pipe to the shower head.

20. The plumbing attachment according to claim 19
wherein the release valve is a two port inline valve;
wherein the release valve is a straight valve.

* * * * *